United States Patent [19]

Bouvet

[11] 3,969,802

[45] July 20, 1976

[54] MILL ROLL

[76] Inventor: Jean Bouvet, P.O. Box 131, Ookala, Hawaii 96774

[22] Filed: Feb. 3, 1975

[21] Appl. No.: 546,694

Related U.S. Application Data

[63] Continuation-in-part of Ser. No. 464,140, April 25, 1974.

[52] U.S. Cl. ..... 29/121 R
[51] Int. Cl.[2] ..... B21B 27/02
[58] Field of Search ..... 29/110, 121 A, 121 R

[56] References Cited

UNITED STATES PATENTS

| | | | |
|---|---|---|---|
| 1,627,966 | 5/1927 | Goodlett | 29/121 A X |
| 1,834,852 | 12/1931 | Kutter | 29/121 A X |
| 3,217,387 | 11/1965 | Strindlund | 29/121 R |
| 3,719,978 | 3/1973 | Clyne | 29/121 R |

FOREIGN PATENTS OR APPLICATIONS

| | | | |
|---|---|---|---|
| 1,277,793 | 9/1968 | Germany | 29/113 AD |

*Primary Examiner*—Alfred R. Guest

[57] ABSTRACT

According to the invention, a mill roll of the type generally used for the grinding and juice extraction of sugar cane and the like has a plurality of peripheral grooves formed circumferentially therein with a number of holes extending radially from the bottom of these grooves into interior channels through which drainage of a further portion of the extracted juice is effected during milling.

5 Claims, 3 Drawing Figures

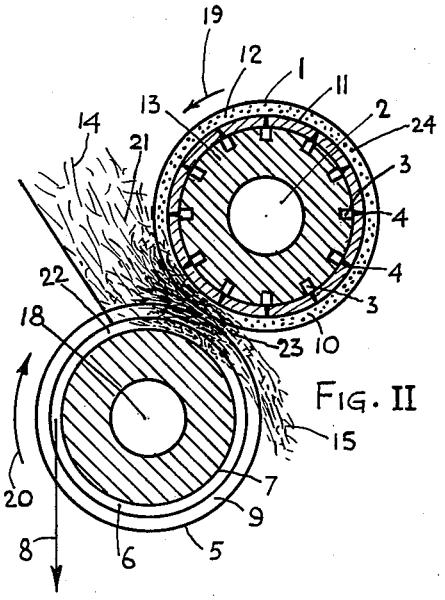
FIG. II
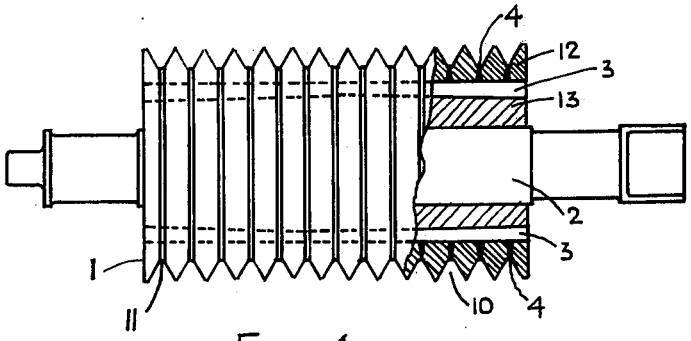
FIG. 1
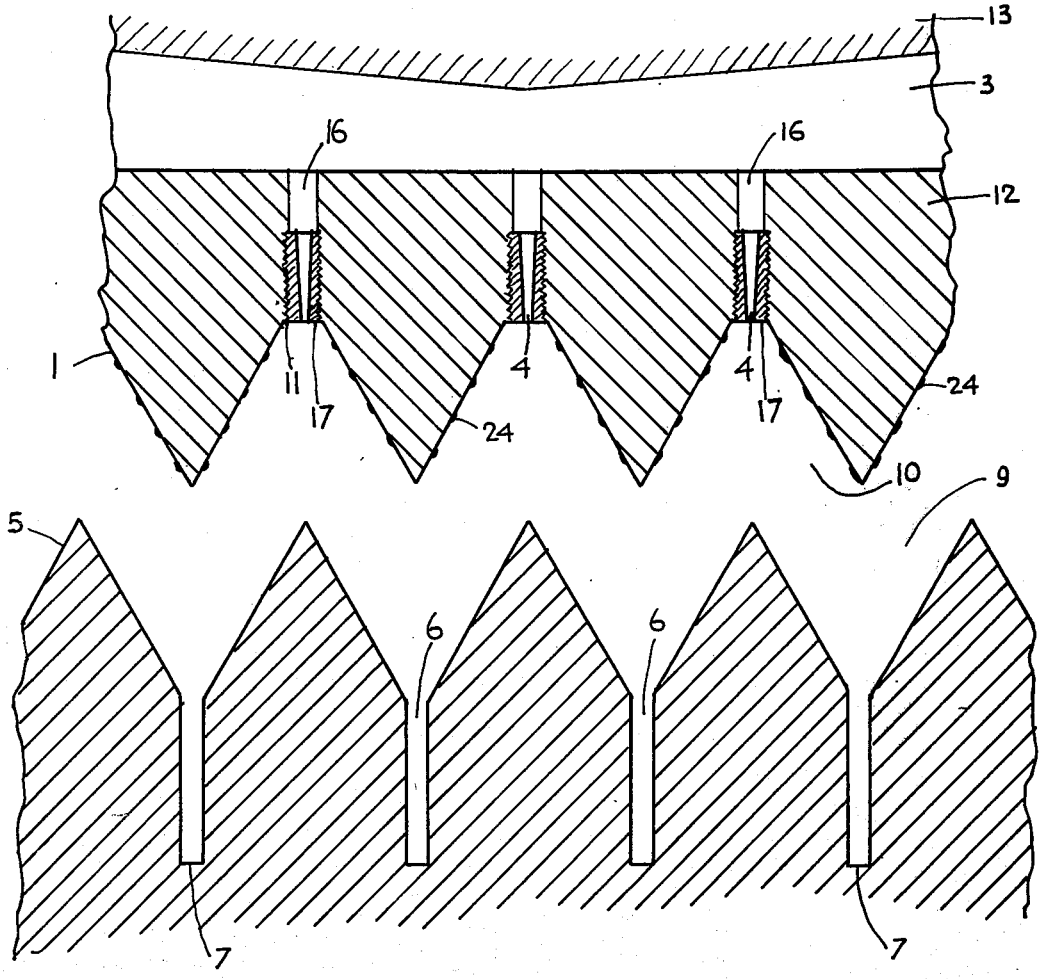
FIG. III

MILL ROLL

PRIOR RELATED APPLICATION

This application is a continuation in part of U.S. Patent Application Ser. No. 464,140 filed Apr. 25, 1974.

BACKGROUND OF THE INVENTION

1. Field of the Invention

This invention relates to milling equipment used for the grinding and juice extraction of sugar cane and the like.

2. Prior Art

Various methods have been employed to promote drainage of the extracted sugar cane juices during milling with a view of improving sugar recovery. The current practice is to have the bottom rolls only of a mill provided with a number of so-called "messchaert grooves" through which the extracted juice escapes. However, a considerable amount of the extracted juice is invariably trapped at the upper part of the cane blanket resulting in subsequent reabsorption and thus impairment of the overall milling performance.

SUMMARY OF THE INVENTION

The object of the invention is to provide a mill roll with means that will improve juice recovery through efficient drainage.

Another particular object of the invention is to provide such a roll to be used as a mill top roll.

Other objects and advantages of the invention will be apparent from the specification and claims, and the drawings.

In accordance with this invention, a mill roll of the type generally used for the grinding and juice extraction of sugar cane and the like has a plurality of peripheral grooves formed circumferentially therein with a number of holes extending from the bottom of these grooves into interior channels through which drainage of a further portion of the extracted juice is effected during milling.

BRIEF DESCRIPTION OF THE DRAWINGS

In the drawings, in which like characters of reference designate like parts throughout the several views thereof, FIG. I is an elevation of a cane mill roll of the type described, partly sectional along its longitudinal axis;

FIG. II is a diagramatic side elevation view of a two roll cane mill embodying the present invention;

FIG. III is a fragmentary sectional view through the mill structure shown in FIG. II, the section being taken approximately along a straight line joining the axes of both rolls.

DESCRIPTION OF THE PREFERRED EMBODIMENT

In the drawings, the two-roll cane mill of FIG. II is shown equipped with a top roll 1 embodying the present invention and a conventional bottom roll 5 provided with so-called "messchaert grooves" 6. Top roll 1 has a number of peripheral V-shaped grooves 10 formed circumferentially therein, all like bottom roll 5 which has a number of similar grooves 9 intermeshing with grooves 10 of roller 1.

As is well-known in the sugar industry, the purpose of a mill is to grind the cane whilst extracting the sucrose contained therein. Efficient grinding of the cane is desirable since it opens the cells containing the sucrose which is then more readily diluted by the so-called "imbibition process" before being extracted by the mills. This grinding effect is due mainly to the shearing action exerted on the cane by the rolls as a result of the relative difference in peripheral speeds of their V-shaped intermeshing grooves for a given diameter and speed of rotation of the rolls. These grooves have the further advantage of increasing the capacity of the mill by exerting a better grip on the material being processed whilst allowing more of the latter to pass through a given mill opening as compared to rolls having smooth surfaces.

But the effectiveness of a given mill does not depend only on its ability to grind the cane. By far, the most important is its ability to extract an optimum amount of juice from the cane. This can only be achieved in keeping reabsorption at a minimum through an efficient juice drainage system.

In conventional mills, juice drainage is invariably effected by means of the messchaert grooves which, however, can only be useful when provided to the bottom roll or rolls of a mill. But this system is still far from satisfactory since a great portion of the juice already extracted is trapped at the top part of the incoming cane blanket whilst reabsorption by the outgoing cane blanket is inevitable and that which constitutes a serious drawback seemingly inherent to all mills.

The following will explain the way in which drainage is effected by means of the messchaert grooves and the main causes of reabsorption : Supposing that a cane blanket 14 is fed continuously into the mill of FIG. II whose rolls 1 and 5 rotate in direction of arrows 19 and 20 respectively; most of the juice contained in the cane being squeezed by rolls 1 and 5, will tend to flow back towards the left into blanket 14 whilst part of it will escape, somewhere around location 22, via grooves 6, in direction of arrow 8. Whereas that portion of the extracted juice lying at the top part of blanket 14, somewhere around location 21, can only escape by percolating down through the latter to grooves 6. But since blanket 14 is constantly moving towards the entrance of the mill, the undrained material at location 21 enters the nip causing highly pressurized liquid pockets to be formed and entrained past the nip and out at exit 23 of the mill where reabsorption of the juice by the outgoing cane blanket 15 occurs.

In the present invention, the mill of FIG. II has its top roll provided with a number of peripheral V-shaped grooves 10 formed circumferentially therein and a plurality of holes 4 conveniently spaced and extending substantially radially from the bottom 11 of each groove 10 into interior channels 3 conveniently disposed throughout the length of roll 1. These holes 4 and channels 3 provide an additional egress through which most of the juice which would otherwise be trapped and entrained past the nip of the mill to cause reabsorption, can readily flow out. Consequently, the efficiency of the mill is considerably improved as a result of its higher juice extraction and grinding capacity, the latter being due to a better grip exerted by the rolls on the relatively drier material going past the nip.

Due to the squeezing action exerted by the rolls on the cane at the nip of the mill, heavy pressures are developed, and to which is subjected the juice going past holes 4 and channels 3. As a result, clogging of these passages by the fine fibers or other impurities which would tend to flow through with the juice, is obviated.

In the accompanying drawings, a preferred construction of roll 1 is illustrated which consists of having a shaft 2 on which is rigidly mounted an intermediate cylindrical body 13 (which may be of steel, cast iron, reinforced concrete or any other suitable material) at the periphery of which are conveniently spaced a number of channels 3 extending throughout the length of roll 1. An outer steel cylindrical shell 12 (which could also be of any other suitable material) is rigidly mounted, in turn, around body 13 and has a number of peripheral V-shaped grooves 10 formed circumferentially therein. The sides of grooves 10 are preferably roughened by means of spot-welds 24 with a view of minimizing wear and slippage. From the bottom of each groove 10, and conveniently spaced, are a plurality of holes 4 which extend through shell 12 into channels 3. The walls of holes 4 are convergent towards the periphery of shell 12, whereas the walls of channels 3 are divergent towards the ends of roll 1, to provide each of said holes 4 and channels 3 with increasing cross-sectional dimension in the direction of the fluid flow, thereby reducing the likelihood of clogging of such passages during operation.

FIG. III shows an alternative method of setting the holes 4 which consists of having holes 16 drilled and tapped before screwing in place inserts 17 containing the holes 4.

While I have shown and described a present embodiment of the invention, it is to be distinctly understood that the invention is not limited thereto but may be otherwise variously embodied within the scope of the following claims. For example, shell 1 may also be provided with cross grooves of the "Chevron" or "Kay" type at its periphery with a view of further preventing slippage.

What I claim is:

1. A mill roll of the character described, to be used in combination with one or more rolls in a mill for grinding a material, such as sugar cane and the like, while extracting the juice therefrom, comprising a rigid body having a plurality of peripheral grooves formed circumferentially thereon, a plurality of channels within the body of the roll extending axialy of the roll throughout the roll body, a plurality of holes extending substantially radially from the bottom of said grooves and communicating with said channels, whereby, during operation, the passage of extracted juice through the holes and channels tends to increase the recovery of juices.

2. A mill roll as recited in claim 1 wherein the walls of said holes and channels are divergent in the direction of fluid flow whereby said holes and channels have diameters of increasing cross-sectional dimension in the direction of fluid flow to mitigate against clogging or otherwise to faciliate fluid flow therethrough.

3. A mill roll as recited in claim 1 wherein the walls of said peripheral grooves are roughened to minimize wear and slippage.

4. A mill roll as cited in claim 1 wherein the walls of said holes are divergent in the radially inward direction so that said holes have increasing cross sectional dimension in said radially inward direction.

5. A mill roll as recited in claim 1 wherein the walls of said channels are divergent towards the ends of said rolls so that said channels have increasing cross-sectional dimensions in directions towards the ends of said roll.

* * * * *